US007261603B2

(12) United States Patent
Takahashi et al.

(10) Patent No.: US 7,261,603 B2
(45) Date of Patent: Aug. 28, 2007

(54) CONNECTOR HAVING A SPACER FOR PREVENTING AN ENTRANCE OF FOREIGN PARTICLES

(75) Inventors: Kenji Takahashi, Shizuoka (JP); Takashi Wakasugi, Shizuoka (JP); Takuji Akiyama, Aichi (JP); Katsutoshi Komatsu, Aichi (JP); Koji Ebisu, Aichi (JP)

(73) Assignees: Yazaki Corporation, Tokyo (JP); Aisin AW Co., Ltd., Anjo-shi (JP)

( * ) Notice: Subject to any disclaimer, the term of this patent is extended or adjusted under 35 U.S.C. 154(b) by 0 days.

(21) Appl. No.: 11/584,749

(22) Filed: Oct. 23, 2006

(65) Prior Publication Data

US 2007/0093131 A1 Apr. 26, 2007

(30) Foreign Application Priority Data

Oct. 24, 2005 (JP) ..... 2005-308250

(51) Int. Cl.
*H01R 13/514* (2006.01)

(52) U.S. Cl. ..... 439/752; 439/595

(58) Field of Classification Search ..... 439/752, 439/595

See application file for complete search history.

(56) References Cited

U.S. PATENT DOCUMENTS 5,066,252 A * 11/1991 Kato et al. ..... 439/752
6,068,512 A * 5/2000 Sugie ..... 439/595
6,402,573 B1 * 6/2002 Yeomans ..... 439/752
7,014,512 B2 * 3/2006 Mase et al. ..... 439/752

FOREIGN PATENT DOCUMENTS

JP 3-29276 2/1991

* cited by examiner

*Primary Examiner*—Hae Moon Hyeon
(74) *Attorney, Agent, or Firm*—Kratz, Quintos & Hanson, LLP

(57) ABSTRACT

The connector includes a connector housing having two terminal fittings and terminal receiving chambers for receiving the terminal fittings, and a spacer 4 to be inserted into the connector housing through an opening. A receptacle for inserting an unlocking jig is formed on the spacer. The receptacle is opened at an outer wall of the spacer and a boundary wall to the connector housing 3. The receptacle is disposed in a manner not to spread across two terminal-receiving chambers. The receptacle communicates with one of the terminal-receiving chambers. A block of a main body of the spacer blocks a path between the receptacle and the other terminal-receiving chamber.

5 Claims, 11 Drawing Sheets

CONNECTOR HAVING A SPACER FOR PREVENTING AN ENTRANCE OF FOREIGN PARTICLES

CROSS REFERENCE TO RELATED APPLICATIONS

This application is based on Japanese Patent Application No. 2005-308250, the contents of which are hereby incorporated by reference.

BACKGROUND OF THE INVENTION

1. Field of the Invention

The present invention relates to a connector having a spacer for preventing terminal fittings received in a connector housing from falling out of the connector housing.

2. Description of the Related Art

Various electronic devices are mounted on a vehicle. A wiring harness is arranged in the vehicle for supplying electric power, control signals, and the like to the electronic devices. The wiring harness includes a plurality of electric wires and a connector. The electric wire is a so-called coated wire having a conductive core wire and an insulating cover.

The connector includes a conductive terminal fitting and an insulating connector housing. The terminal fitting is formed by bending a metal plate. The connector housing is made in a box shape and receives the terminal fitting. The connector is connected to the connector of the electronic devices. The wiring harness supplies the electric power and the control signals owing to the connector connected to the connector of the electronic devices.

Japanese published patent application No. H3-29276 discloses a connector having a spacer for preventing the terminal fitting from falling out of the connector housing.

As shown in FIGS. 9 and 10, in such a connector 101, an opening 105 into which a spacer 104 is inserted into is formed on an outer wall of a connector housing 103 receiving a plurality of terminal fittings 102. Because the spacer 104 inserted into the opening 105 presses the terminal fittings 102 received in the connector housing 103, the terminal fittings 102 are prevented from falling out of the connector housing 103.

In the connector 101, when the spacer 104 is inserted into the connector housing 103, a locking part 106 formed on the spacer 104 is pressed into a mating part 107 formed inside the connector housing 103, so that the spacer 104 is fixed to the connector housing 103. For taking out the spacer 104 from the connector housing 103, a jig 200 is inserted into a receptacle 108 mounted on an edge of the spacer 104, opened toward the opening 105, and twisted.

However, such a connector 101 is often used in lubricating oil of an automatic transmission. In the lubricating oil of the automatic transmission, foreign particles such as metallic powder generated by a gear abrasion float. The foreign particles easily enter an inside of the connector housing 103 from the receptacle 108. Further, because the receptacle 108 communicates with the terminal fittings 102, there is a fear that the terminal fittings 102 may be short-circuited by the foreign particles entering the connector housing 103 from the receptacle 108 in a direction of an arrow E in FIG. 11 and adhered to the terminal fittings 102. For preventing an invasion of the foreign particles, a waterproofing connector of which inside and outside thereof are sealed may be used. However, such a waterproofing connector cannot be downsized.

Accordingly, an object of the present invention is to provide a connector that prevents terminals from being short-circuited caused by an invasion of foreign particles into a connector housing.

SUMMARY OF THE INVENTION

In order to attain the object, according to the present invention, there is provided a connector including:

a connector housing receiving a plurality of terminal fittings;

a spacer to be inserted into an opening through an outer wall of the connector housing and to lock the connector housing for preventing the terminal fittings from falling out of the connector housing; and a receptacle interposed between the connector housing and the spacer for inserting a jig for unlocking the spacer, wherein while the spacer locks the connector housing, the receptacle communicates with one terminal-receiving chamber receiving one terminal fitting, and the connector includes a block for blocking a path between the receptacle and the other terminal-receiving chambers receiving the other terminal fittings.

Preferably, the block is projected from one of the connector housing or the spacer to the other, and interposed between the one and the other terminal-receiving chambers.

Preferably, the connector further includes a rib mounted on the other one of the connector housing or the spacer, and is overlapped with the block.

Preferably, the block is extended in a line in a direction of inserting the spacer into the connector housing.

Preferably, the receptacle is mounted on the spacer.

These and other objects, features, and advantages of the present invention will become more apparent upon reading of the following detailed description along with the accompanied drawings.

DETAILED DESCRIPTION OF THE PREFERRED EMBODIMENTS

First Embodiment

A first embodiment of a spacer of a connector 1 according to the present invention will be described with reference to FIGS. 1 to 5.

Figure 1:
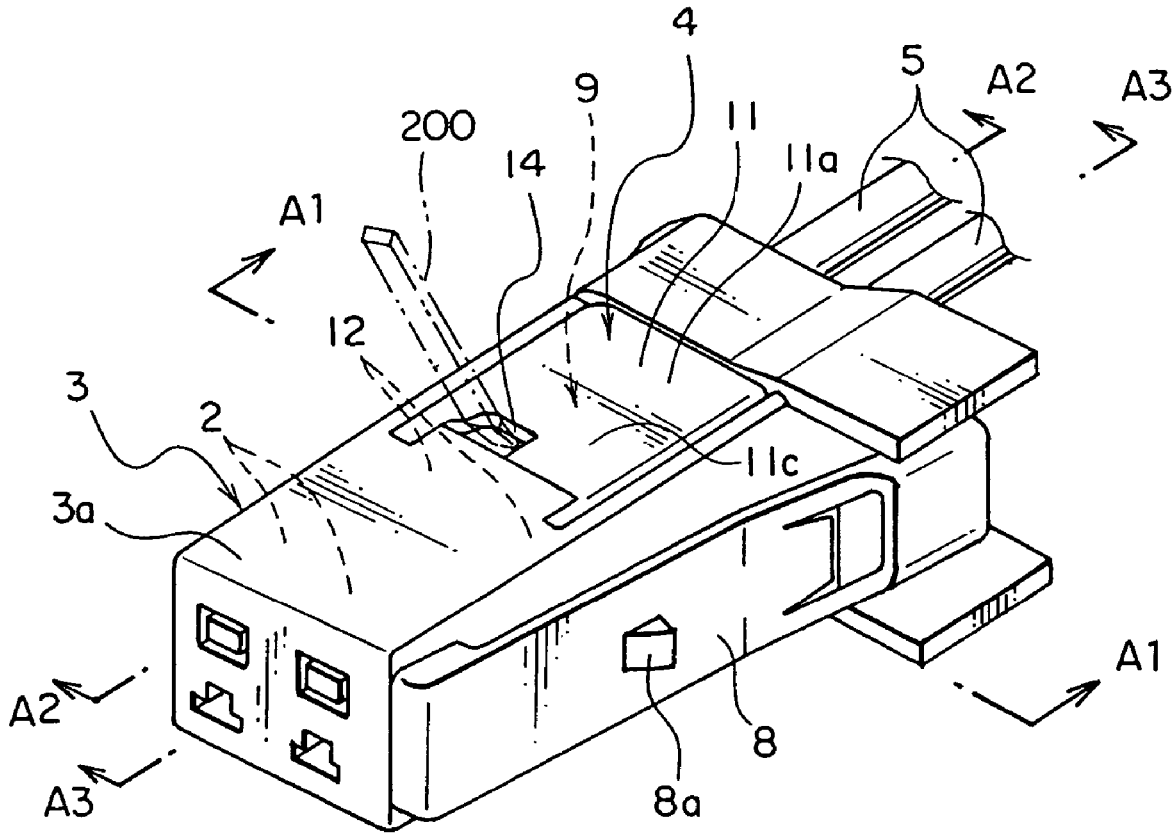
FIG. 1 is a perspective view showing a first embodiment of a connector according to the present invention.
Figure 2:
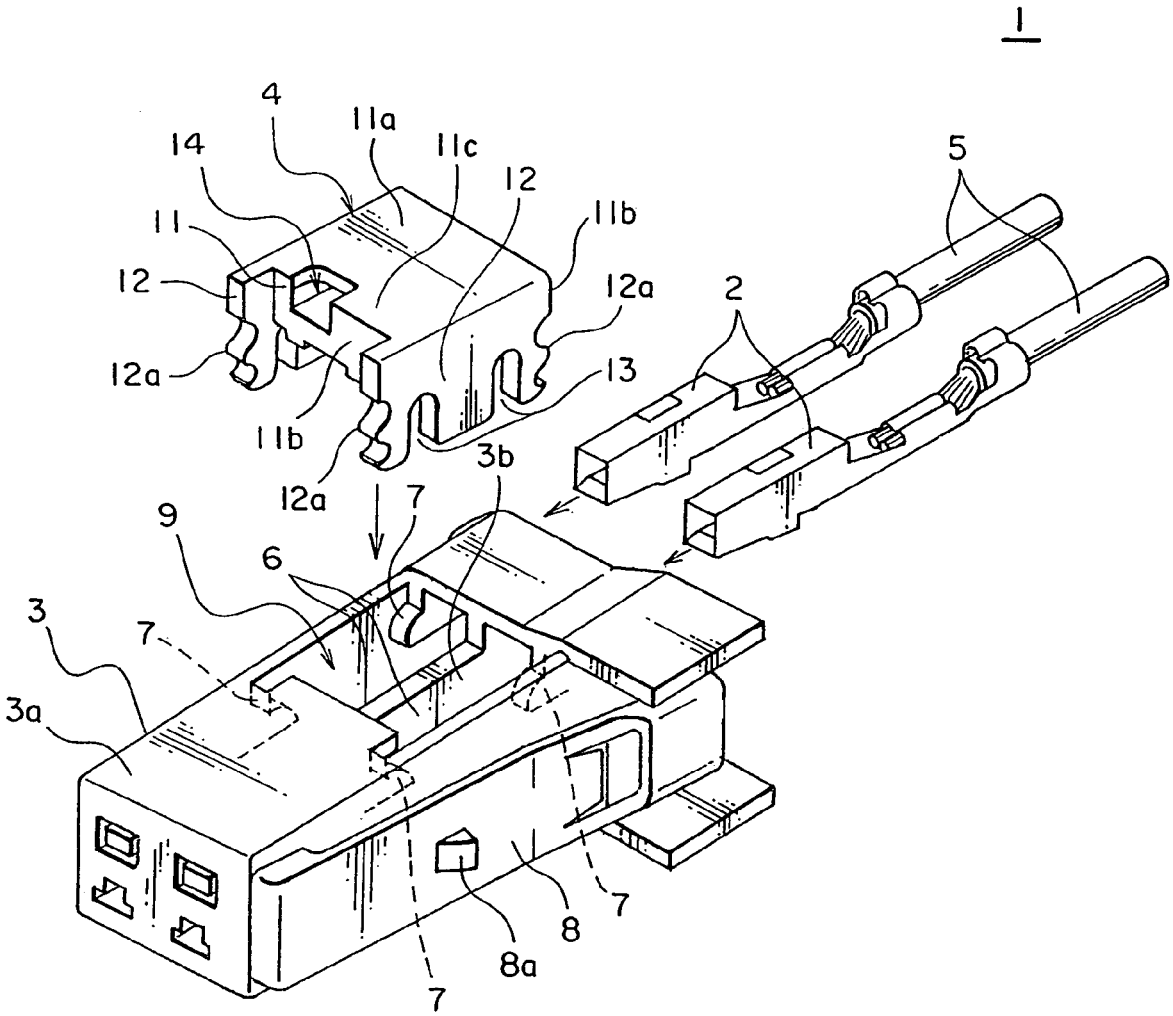
FIG. 2 is an exploded view showing the connector of FIG. 1.

As shown in FIGS. 1 and 2, the connector 1 composes a wiring harness to be arranged in a vehicle, and in particular, in this embodiment, the connector 1 is used in lubricating oil in an automatic transmission of the vehicle. The connector 1 includes a terminal fitting 2, a connector housing 3, a spacer 4, and a receptacle 14.

Bending a metal plate makes the terminal fitting 2. The terminal fitting 2 is attached to an end of an electric wire 5 composing the wiring harness. The terminal fitting 2 is electrically connected to a core wire of the wire 5.

The connector housing 3 is made of synthetic resin in a box shape composed of a plurality of outer walls 3*a*. The connector housing 3 includes a plurality of terminal-receiving chambers at an inside thereof and a locking arm for locking the mating connector at an outside thereof.

The terminal-receiving chamber 6 is formed in a tubular shape, and composed of an outer wall 3*a* of the connector housing 3 and a partition wall 3*b* partitioning the connector housing 3. A plurality of terminal-receiving chambers 6 is arranged in parallel and receives terminal fittings 2. In this embodiment, the connector housing includes two terminal-receiving chambers 6.

The locking arm 8 is formed integrally with the outer wall 3*a*. One end of the locking arm 8 is continued to the outer wall 3*a*. Namely, the outer wall 3*a* supports only one side of the locking arm 8. The locking arm 8 includes a locking projection 8*a* projected toward an outside of the connector housing 3. When the locking arm 8 is bent inside the connector housing 3, the locking projection 8*a* is engaged with a not-shown mating part of a mating connector housing.

As shown in FIG. 2, an opening 9 having substantially a rectangular shape in top view is formed on the outer wall 3*a* of the connector housing 3. The opening 9 communicates with inside and outside of the connector housing 3. Namely, the opening 9 communicates with the inside and outside of two of the terminal-receiving chambers 6. A later-described spacer 4 is inserted into the opening 9. A part below the opening 9, namely, blocked by the spacer 4 of the partition wall 3*b* is cut off, and the terminal-receiving chambers 6 communicate with each other. Further, mating parts 7 for engaged with locking parts 12 of the spacer 4 are formed on an inner wall of the connector housing 3.

The spacer 4 is inserted into the connector housing 3 through the opening 9. Then, the spacer 4 presses the terminal fitting 2 in a manner to block an inside of the connector housing 3, so that the terminal fitting 2 is prevented from falling out from the connector housing 3. The spacer 4 includes integrally a flat main body 11 blocking the inside of the connector housing 3 and a pair of locking parts 12 extended from both edges of the main body 11. The spacer 4 is formed in a U-shape.

The main body 11 has a same shape as the opening 9 in a plan view. When the spacer 4 locks the connector housing 3, an outer surface 11*a* of the main body 11 is arranged in a same plane with the outer wall 3*a* having the opening 9.

Both ends 12*a* of the locking parts 12 are formed in wavy shapes for engaging with the mating parts 7. Two slits are formed on each locking part 12 toward the main body 11.

The spacer 4 is inserted into the connector housing 3 in a direction orthogonal to a length direction of the terminal fitting 2 received in the terminal-receiving chamber 6. Both ends 12*a* are pressed against the mating parts 7 and once deformed toward the slits 13. Then, the ends 12*a* are engaged with the mating parts 7 to lock the connector housing 3.

Figure 3:
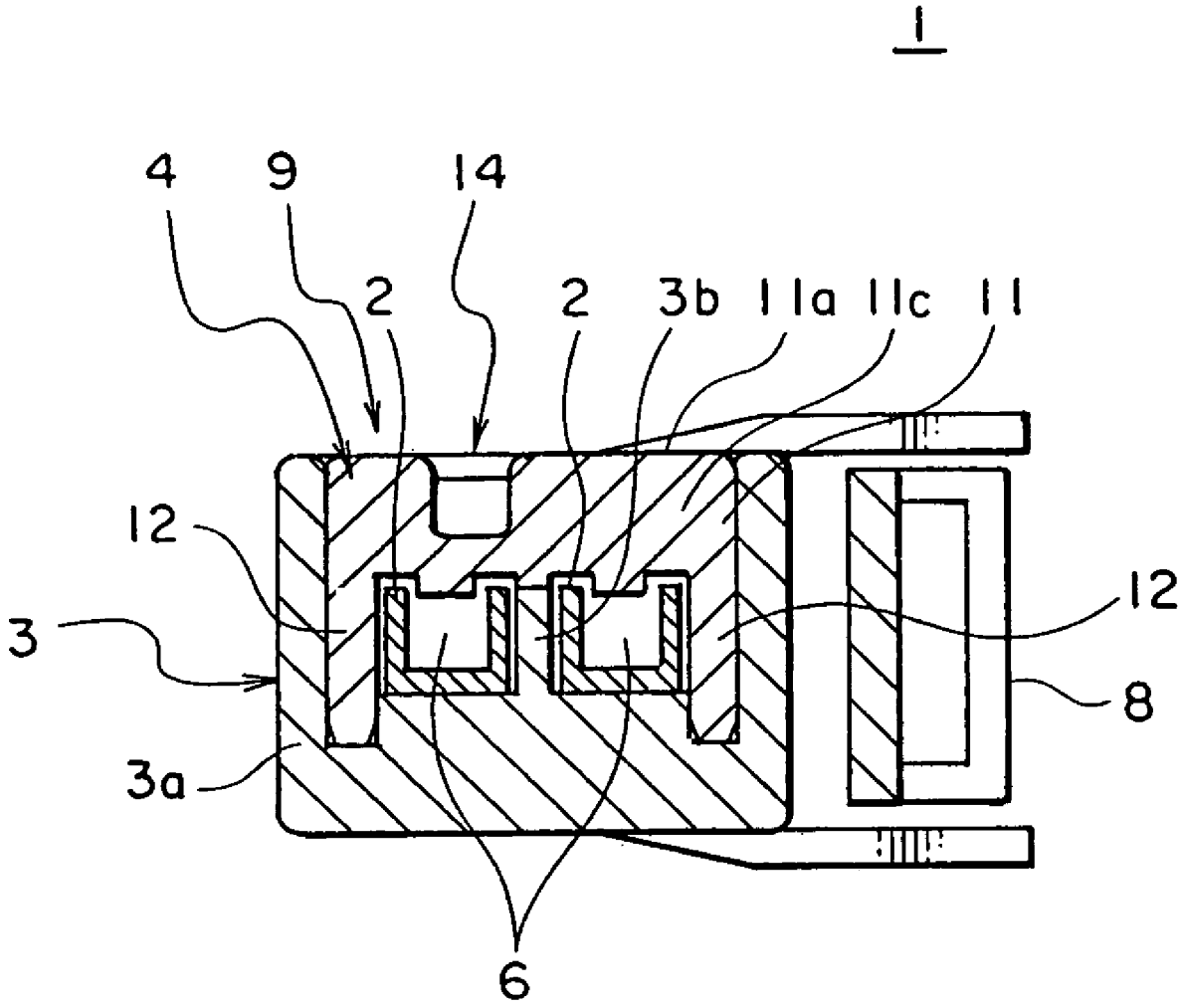
FIG. 3 is a sectional view taken on line A1-A1 of FIG. 1.
Figure 4:
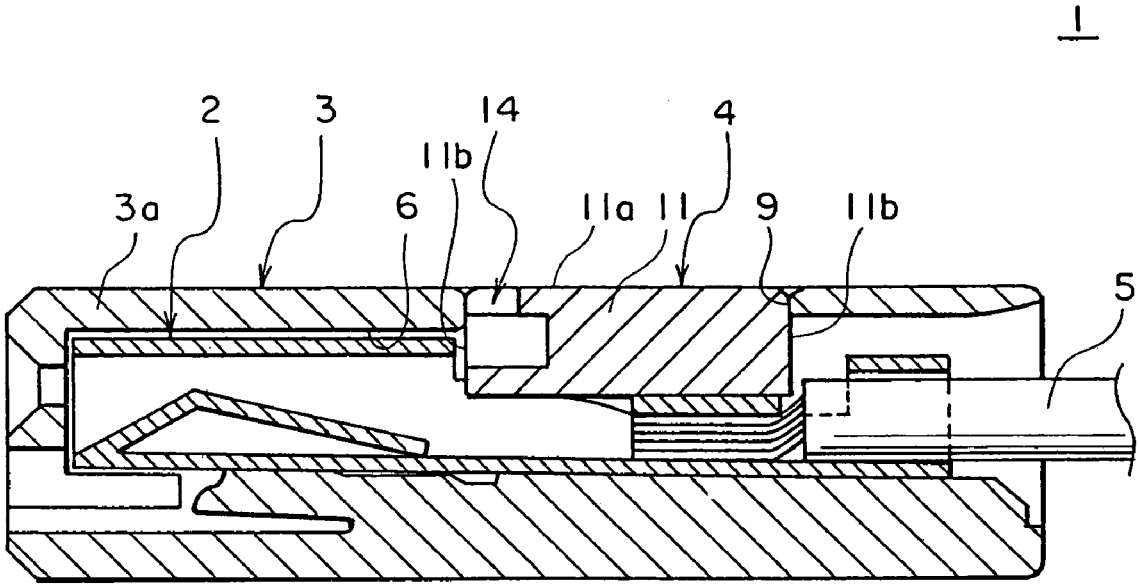
FIG. 4 is a sectional view taken on line A2-A2 of FIG. 1.
Figure 5:
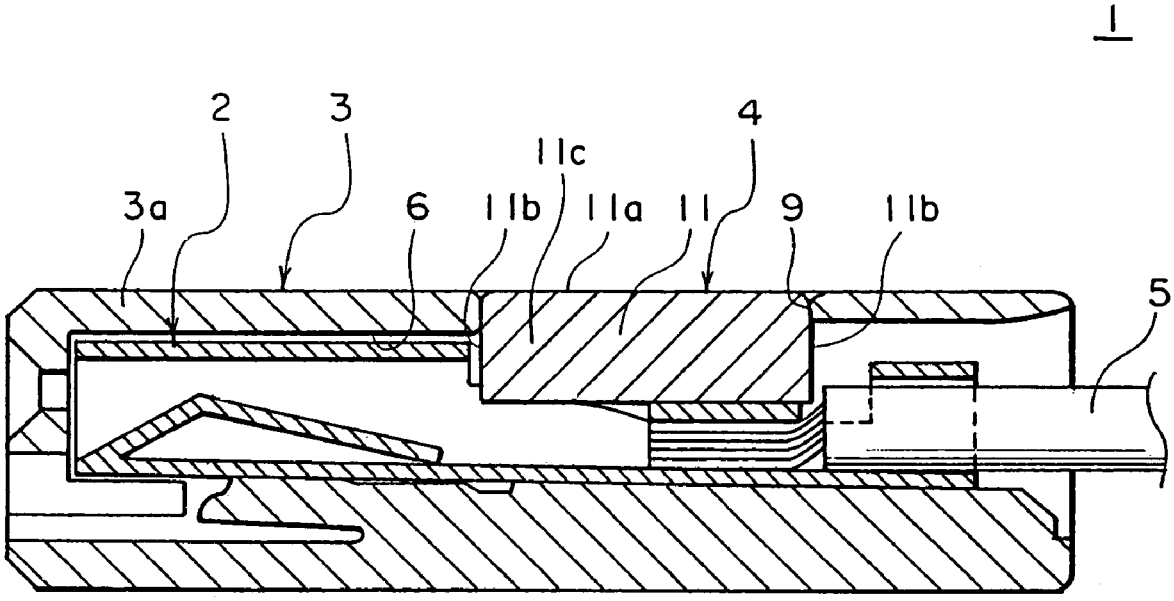
FIG. 5 is a sectional view taken on line A3-A3 of FIG. 1.

A jig 200 is inserted into the receptacle 14 for unlocking the spacer 4. In this embodiment, the receptacle 14 is formed on the spacer 4. The receptacle 14 is a hole opened for both the outer wall 11*a* of the spacer 4 and a boundary wall 11*b* against the connector housing 3. As shown in FIG. 3, the receptacle 14 does not spread across two terminal-receiving chambers 6. The receptacle 14 is biased to one of the terminal-receiving chambers 6 against the partition wall 3*b* interposed between two terminal-receiving chambers 6. As shown in FIG. 4, the receptacle 14 communicates with one of the terminal-receiving chambers 6. As shown in FIG. 5, the path between the receptacle 14 and the other terminal-receiving chamber 6 is blocked by the main body 11 of the spacer 4. Therefore, even if the foreign particles such as metal powder enter the one of the terminal-receiving chamber 6 from the receptacle 14, the foreign particles cannot adhere to two of the terminal fittings 2. Incidentally, a block 11*c* is disposed near the other terminal-receiving chamber 6. The block 11*c* is extended along the whole length of the main body 11 in a length direction of the terminal-receiving chamber 6.

When unlocking the connector housing 3 with the spacer 4, as shown in FIG. 1, the tapered bar-shaped jig 200 is inserted into the receptacle 14 and the spacer 4 is pried with the jig 200 to remove the spacer 4 from the connector housing 3.

According to the first embodiment, because the receptacle 14 communicates with the one of the terminal-receiving chambers 6, and the block 11*c* blocks the path between the receptacle 14 and the other terminal-receiving chamber 6, the foreign particle invading the connector housing 3 through the receptacle 14 cannot adhere to both of the terminal fittings 2. Thus, the short circuit due to the foreign particles invading the connector housing 3 is prevented.

Further, according to the first embodiment, because the receptacle 14 is formed on the spacer 4, the connector housing 3 has no hole as a receptacle. Therefore, variations in a production of the connector housing 3 are reduced.

Second Embodiment

Next, a second embodiment of the connector according to the present invention will be explained with reference to FIGS. 6 to 8.

A connector 1' of the second embodiment is also used in the lubricating oil in the automatic transmission of a vehicle. The connector 1' includes a terminal fitting 2, a connector housing 3', a spacer 4', and two receptacles 14. In the second embodiment, two receptacles 14 are mounted respectively on one boundary wall 11*b* and the other boundary wall 11*b*.

The connector housing 3' includes an extending wall 16 projected from the partition wall 3*b* to the inserted spacer 4'. When the spacer 4' is inserted, the extended wall 16 extends longer than the receptacle 14 in the length direction of the connector housing 3' from an edge of the opening 9, and extends to the outer wall 3*a* in a direction of inserting the spacer 4'. Namely, an edge of the extending wall 16 near the outer surface 11*a* is arranged in a same plane with the outer wall 3*a*. Further, two extending walls 16 are mounted sandwiching the spacer 4' and spaced with each other. In the first embodiment, the partition wall 3*b* is cut off below the opening 9, however, in the second embodiment, the extending wall 16 is formed, and a concave 17 is formed on the spacer 4' for receiving the extending wall 16.

The spacer 4' includes a rib 15 interposed between the concave 17 and the receptacle 14 and overlapped with the extending wall 16.

Figure 8:
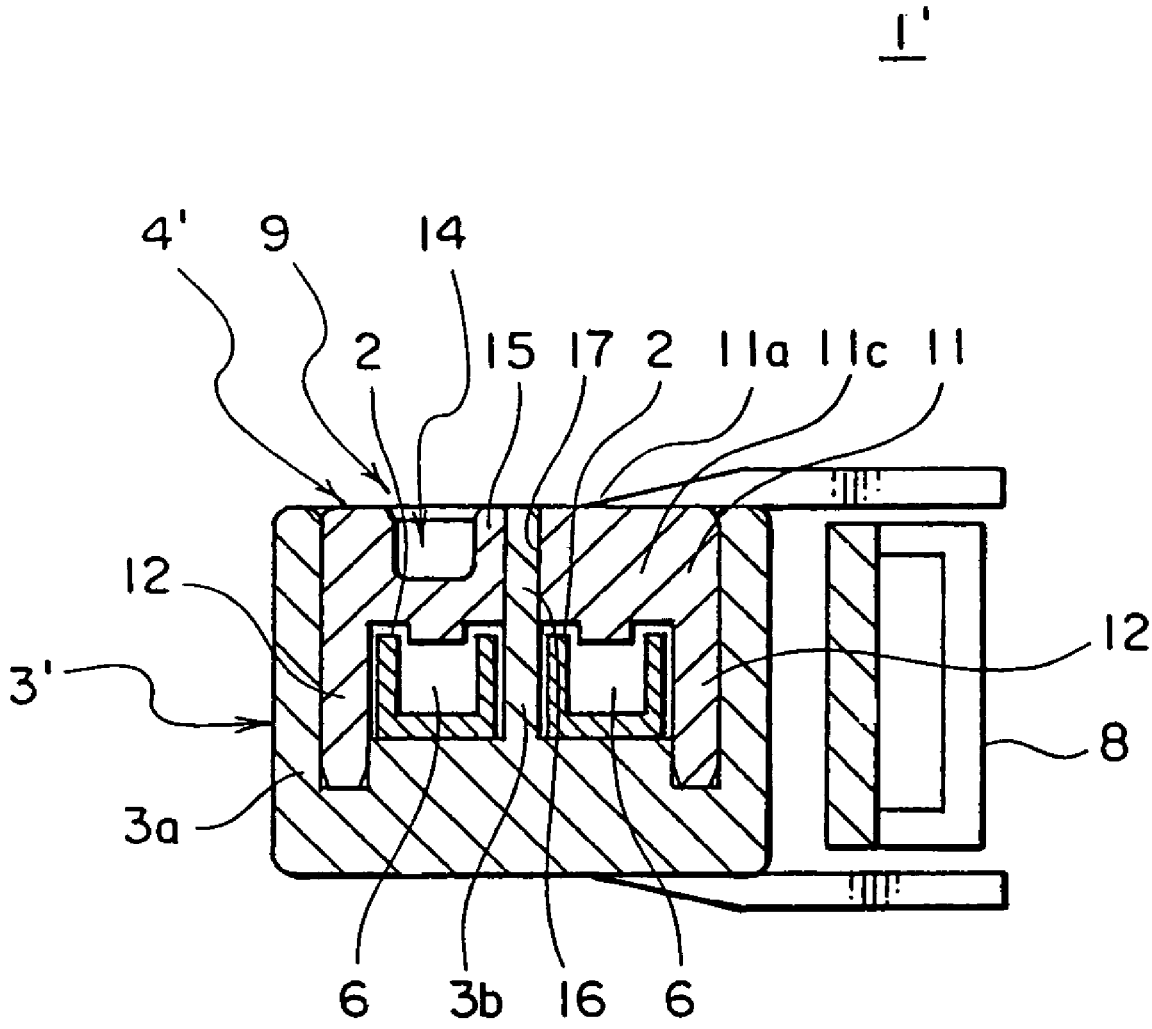
FIG. 8 is a sectional view taken on line B-B of FIG. 6.
Figure 9:
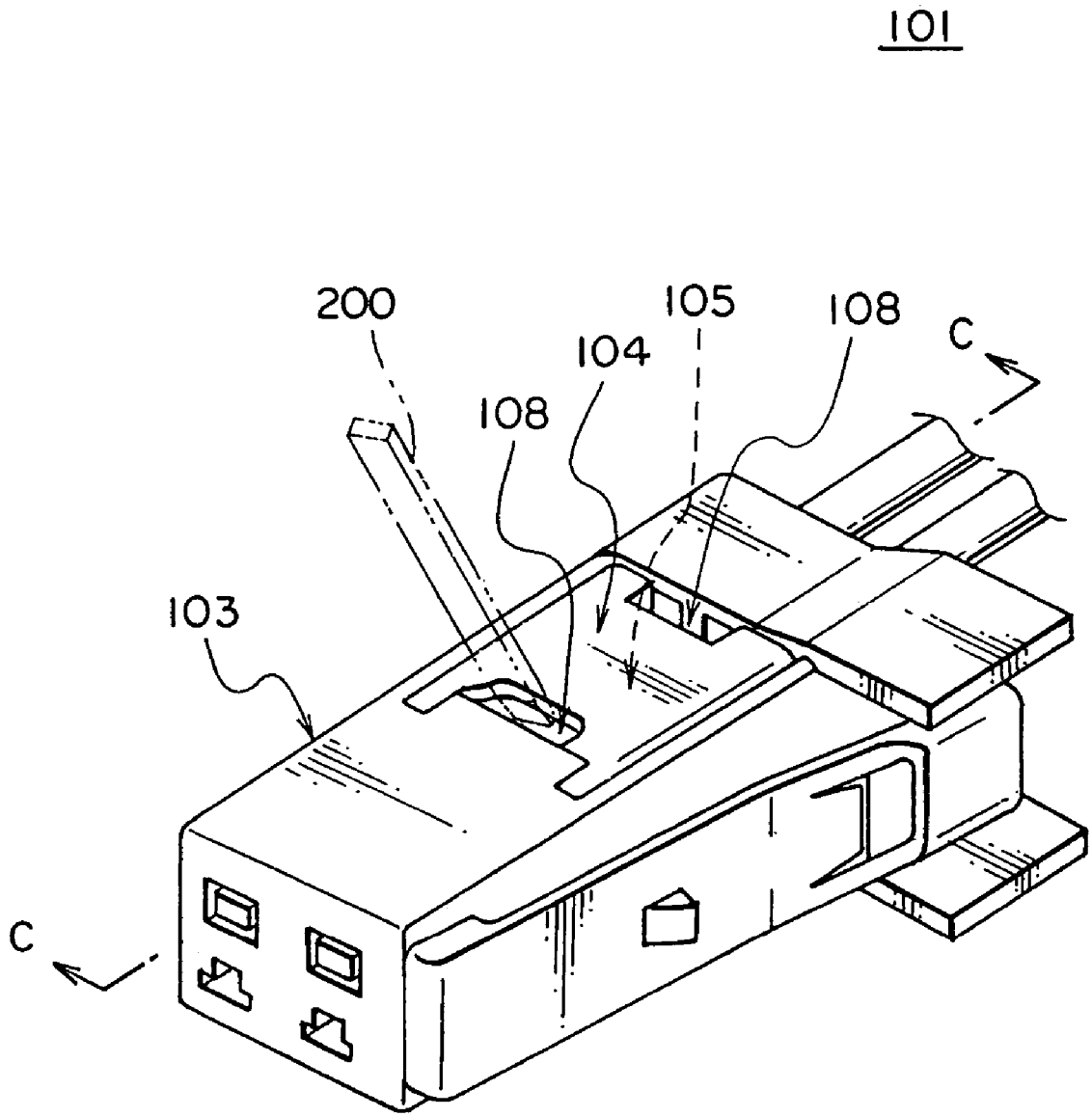
FIG. 9 PRIOR ART
FIG. 9 is a perspective view showing a conventional connector.
Figure 10:
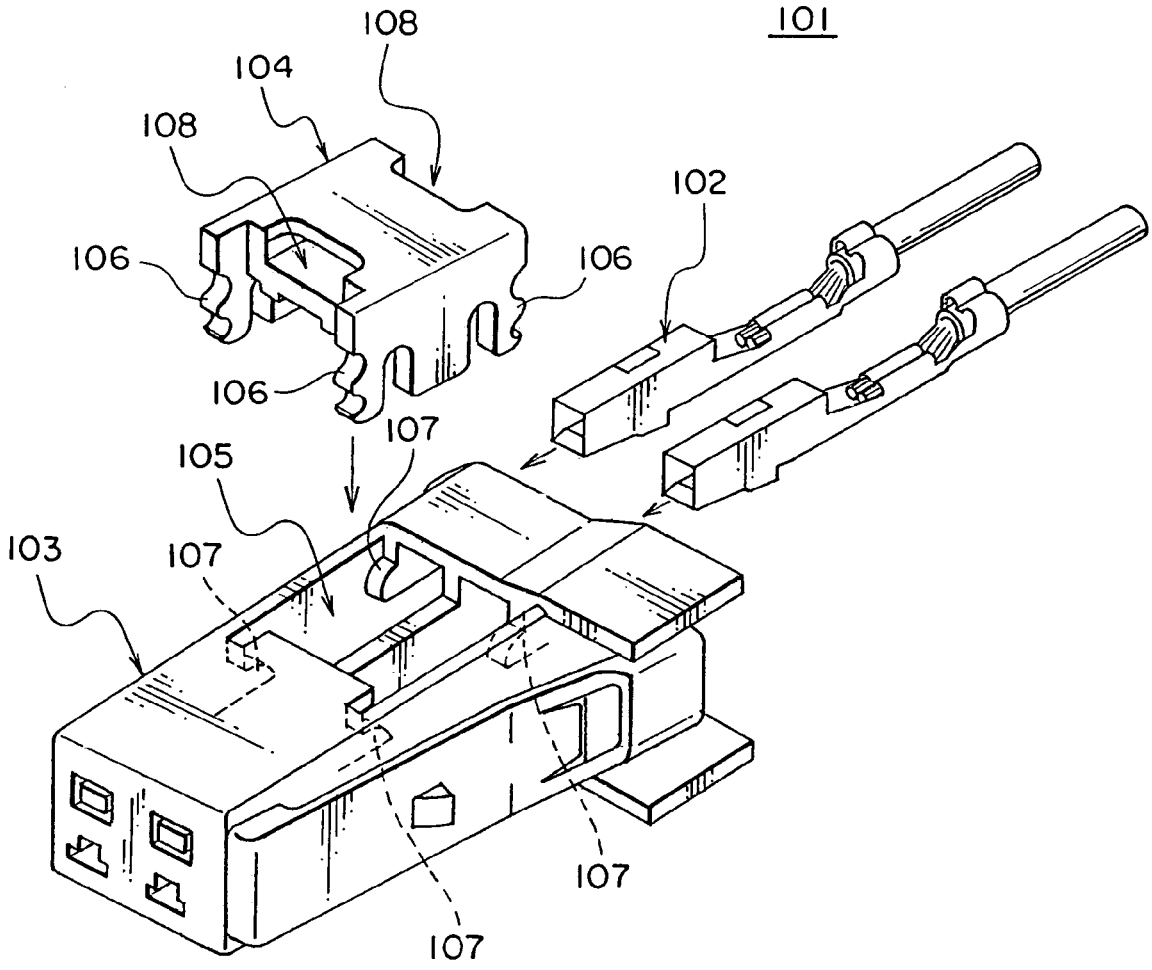
FIG. 10 PRIOR ART
FIG. 10 is an exploded view showing the conventional connector of FIG. 9.
Figure 11:
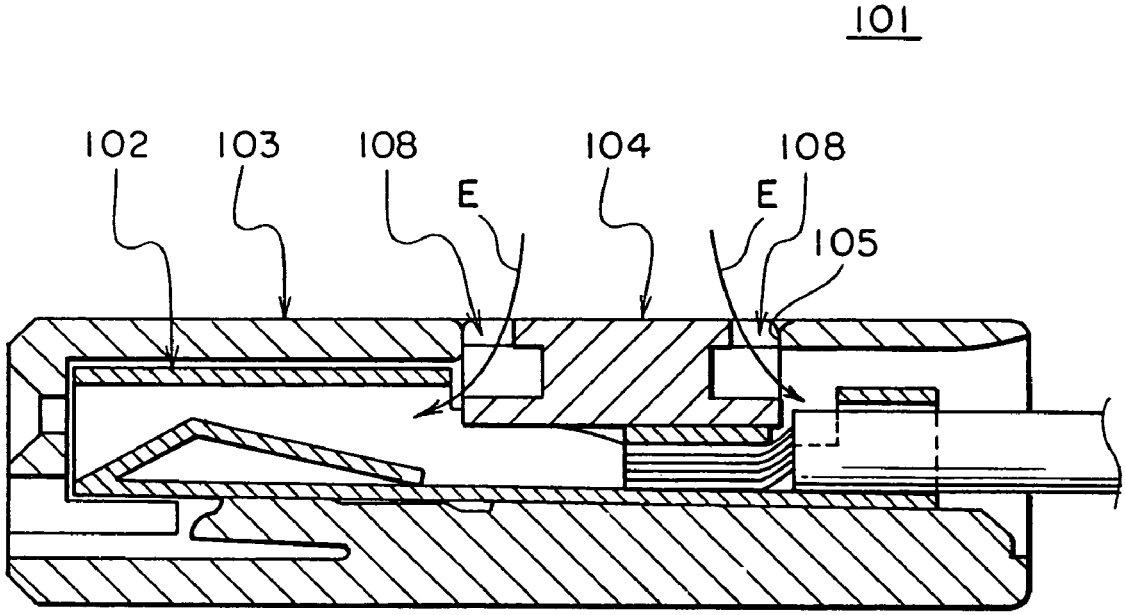
FIG. 11 PRIOR ART
FIG. 11 is a sectional view taken on line C-C of FIG. 9.

As shown in FIG. 8, in the connector 1', the receptacle 14 also does not spread across two terminal-receiving chambers 6. The receptacle 14 is disposed nearer the one of the terminal-receiving chambers 6 than the partition wall 3*b*, namely, the extending wall 16. Namely, the receptacle 14 communicates with the one of the terminal-receiving chamber 6, and the path between the receptacle 14 and the other terminal-receiving chamber 6 is blocked by the block 11*c*, the extending wall 16, and the rib 15. Therefore, even if the foreign particle invading from the receptacle 14 reaches the one of the terminal-receiving chambers 6, the foreign particle cannot adhere to two terminal fittings. Because a path between the receptacle 14 and the other terminal-receiving chamber 6 is complex, the foreign particle seldom reaches the other terminal-receiving chamber 6. Incidentally, the claimed block consists of the block 11*c* and the extending wall 16.

Figure 6:
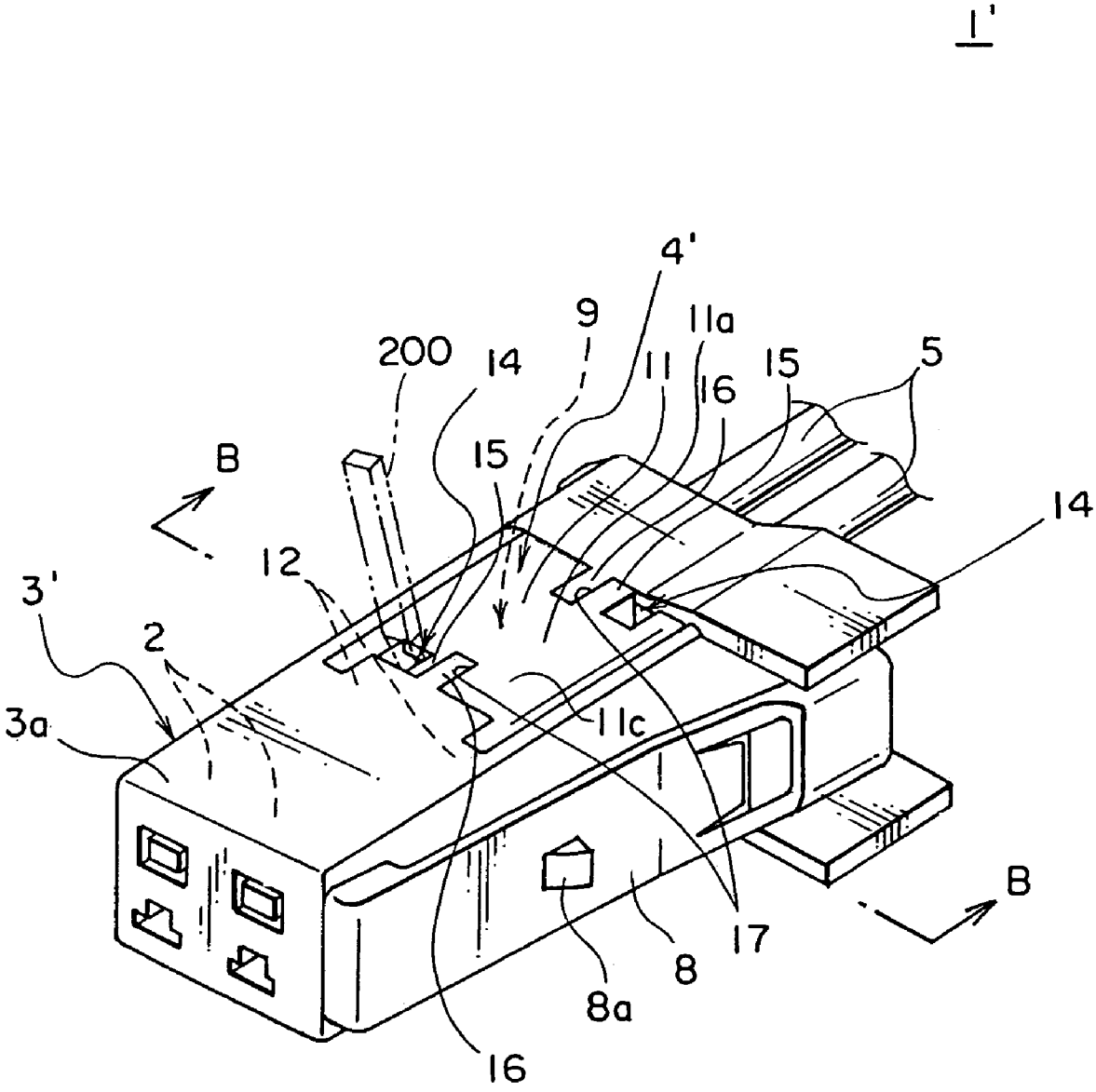
FIG. 6 is a perspective view showing a second embodiment of the connector according to the present invention.
Figure 7:
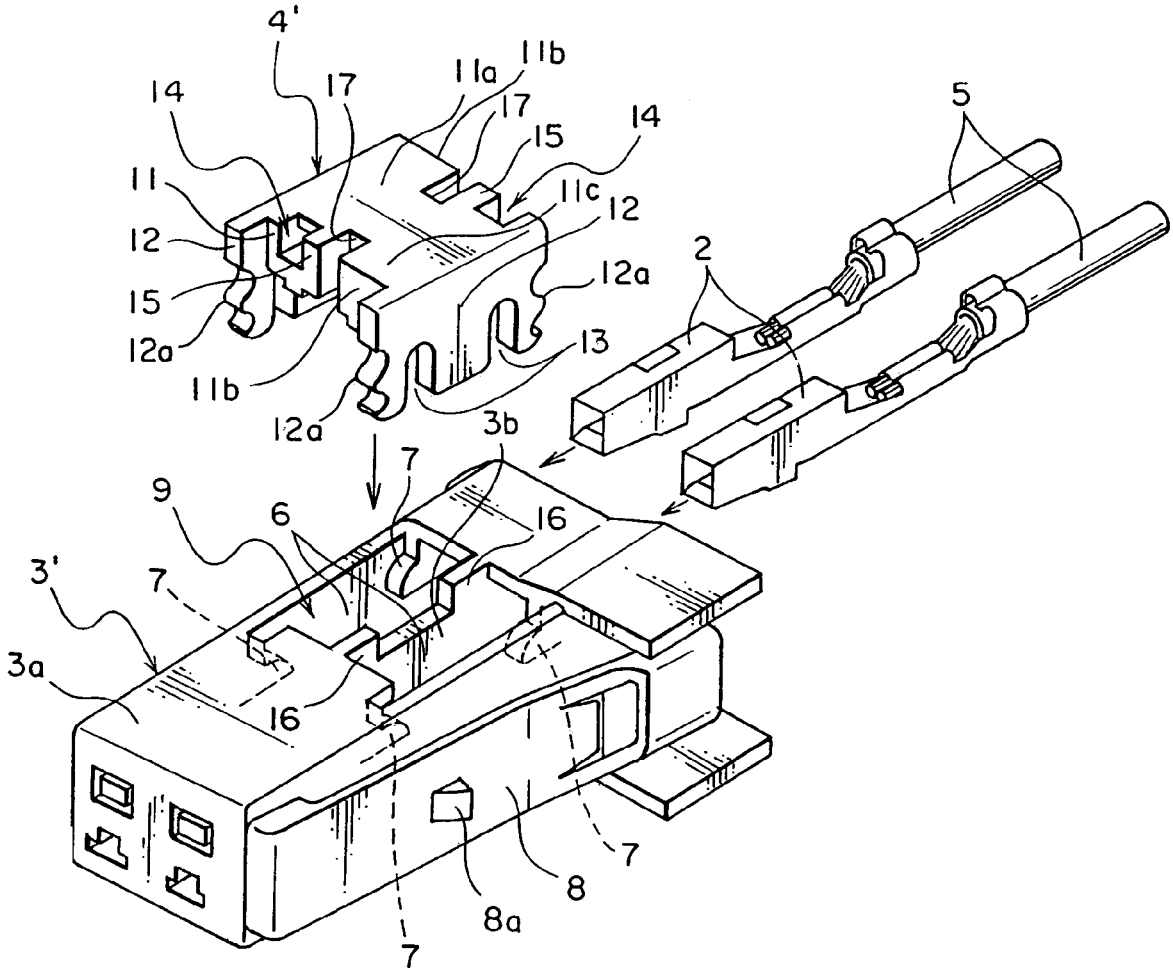
FIG. 7 is an exploded view showing the connector of FIG. 6.

When unlocking the connector housing 3' with the spacer 4', as shown in FIG. 6, the jig 200 is inserted into the receptacle 14 and the spacer 4' is pried with the jig 200 to remove the spacer 4' from the connector housing 3'.

According to the second embodiment, because the receptacle 14 communicates with the one of the terminal-receiving chambers 6, and the path between the receptacle 14 and the other terminal-receiving chamber 6 is blocked by the block 11*c*, the extending wall 16, and the rib 15, the foreign particle invading the connector housing 3' through the receptacle 14 cannot adhere to two terminal fittings 2, and the foreign particle seldom reaches the other terminal-receiving chamber 6. Therefore, the short circuit between the terminals due to the foreign particles invading the connector housing 3' is surely prevented.

Further, according to the second embodiment, the extending wall 16 extends in a direction of inserting the spacer 4' into the connector housing 3'. Therefore, when the spacer 4' is inserted into the connector housing 3', the extending wall 16 works as a guide. Accordingly, the connector 1' is easily assembled.

In the first embodiment, only one receptacle 14 is used. However, as shown in the second embodiment, a plurality of receptacle 14 may be used. Further, in the first and second embodiments, the receptacle 14 is mounted on the spacer 4, 4'. However, the receptacle 14 may be mounted on the connector housing 3, 3'.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A connector comprising:

a connector housing receiving a plurality of terminal fittings;

a spacer inserted into an opening through an outer wall of the connector housing and to lock the connector housing for preventing the terminal fittings from falling out of the connector housing; and a receptacle interposed between the connector housing and the spacer for inserting a jig for unlocking the spacer, wherein while the spacer locks the connector housing, the receptacle communicates with one terminal-receiving chamber receiving one terminal fitting, and the connector includes a block for blocking a path between the receptacle and the other terminal-receiving chambers receiving the other terminal fittings.

2. The connector as claimed in claim 1, wherein the block is projected from one of the connector housing or the spacer to the other, and interposed between the one and the other terminal-receiving chambers.

3. The connector as claimed in claim 2, further comprising a rib mounted on the other one of the connector housing or the spacer, and overlapped with the block.

4. The connector as claimed in claim 1, wherein the block is extended in a line in a direction of inserting the spacer into the connector housing.

5. The connector as claimed in claim 1, wherein the receptacle is mounted on the spacer.

* * * * *